US007847737B2

(12) United States Patent
Kuroda

(10) Patent No.: US 7,847,737 B2
(45) Date of Patent: Dec. 7, 2010

(54) ANTENNA APPARATUS

(75) Inventor: Shinichi Kuroda, Tokyo (JP)

(73) Assignee: Sony Corporation, Tokyo (JP)

( * ) Notice: Subject to any disclaimer, the term of this patent is extended or adjusted under 35 U.S.C. 154(b) by 205 days.

(21) Appl. No.: 12/169,094

(22) Filed: Jul. 8, 2008

(65) Prior Publication Data

US 2009/0015499 A1 Jan. 15, 2009

(30) Foreign Application Priority Data

Jul. 9, 2007 (JP) ..... P2007-180354

(51) Int. Cl.
*H01Q 1/38* (2006.01)

(52) U.S. Cl. ..... 343/700 MS; 343/909

(58) Field of Classification Search ..... 343/700 MS, 343/841, 846, 909

See application file for complete search history.

(56) References Cited

U.S. PATENT DOCUMENTS 6,307,508 B1 10/2001 Nagasawa
7,471,247 B2 * 12/2008 Saily et al. ..... 343/700 MS
2008/0204347 A1 * 8/2008 Alvey et al. ..... 343/841

FOREIGN PATENT DOCUMENTS

JP 11-103213 4/1999

OTHER PUBLICATIONS

D. Sievenpiper, et al., "High-Impedance Electromagnetic Surfaces with a Forbidden Frequency Band", IEEE Transactions on Microwave Theory and Techniques, vol. 47, No. 11, pp. 2059-2074 (1999).

* cited by examiner

*Primary Examiner*—Michael C Wimer
(74) *Attorney, Agent, or Firm*—Finnegan, Henderson, Farabow, Garrett & Dunner, LLP

(57) ABSTRACT

An antenna apparatus includes a patch antenna unit in which a radiation conductor and a ground conductor plate are arranged so as to face each other with an insulating material disposed therebetween, a power-feed point is provided at a position slightly offset from the center of the radiation conductor, and a high-frequency electric field is supplied between the radiation conductor and the ground conductor plate; a surface-wave propagation suppression area in which a surface-wave propagation suppression mechanism for suppressing surface-wave propagation is mounted in an outer surrounding area in the offset direction of the power-feed point in which an electric-field intensity is generally maximum within the end portion of the radiation conductor plate; and an insulating area in which an electric-field intensity between the radiation conductor plate and the ground conductor plate is relatively low and the surface-wave propagation suppression mechanism is not arranged.

3 Claims, 8 Drawing Sheets

ANTENNA APPARATUS

CROSS REFERENCES TO RELATED APPLICATIONS

The present invention contains subject matter related to Japanese Patent Application JP 2007-180354 filed in the Japanese Patent Office on Jul. 9, 2007, the entire contents of which are incorporated herein by reference.

BACKGROUND OF THE INVENTION

1. Field of the Invention

The present invention relates to an antenna apparatus used to transmit and receive wireless signals and, particularly, relates to an antenna apparatus having a patch antenna configuration in which a radiation conductor and a ground conductor plate are arranged so as to face each other with an insulating material disposed therebetween.

More particularly, the present invention relates to an antenna apparatus in which radiation of unwanted electromagnetic waves resulting from surface waves generated on an antenna substrate is suppressed, and distortion of a radiation pattern is thereby reduced and, particularly, relates to an antenna apparatus in which AMC (Artificial Magnetic Conductor) elements having resonance characteristics are mounted in the area surrounding a patch antenna unit.

2. Description of the Related Art

In wireless communication using a radio-wave communication method, signals are propagated by using a radiation electric field generated when electrical current is made to flow through an antenna. There are various types of antennas. In particular, examples of an antenna meeting the demand for a low-profile antenna include an antenna apparatus configured in such a manner that a radiation conductor and a ground conductor plate are arranged so as to face each other with an insulating material disposed therebetween, that is, a microstrip patch antenna (hereinafter will be simply abbreviated as a "patch antenna").

FIG. 6 shows an example of the configuration of a patch antenna. For the shape of the radiation conductor plate, a rectangular shape as shown in the figure or a circular shape is used. For an insulating body, a dielectric is used, and the thickness thereof is approximately 1/10 of the wavelength of the wireless frequency or smaller; therefore the insulating body has a low profile. In actual manufacture, since the patch antenna is often manufactured by performing etching processing on a dielectric substrate, both sides of which are copper-clad, manufacturing is easy, and integration with a circuit substrate is easy.

According to the microstrip patch antenna having such a configuration, radiation directivity when it is excited in the lowest order mode (a $TM_{10}$-mode in the case of a rectangular shape) generally indicates a single direction of a z-axis direction, and a directional gain of approximately several dBi is obtained. Furthermore, a power-feed point is provided at a position slightly offset from the center of the radiation conductor. As the electrical current components in an offset direction (that is, in an x-axis direction in the figure) increase, a radiation electric field is generated, and a standing wave is excited. Then, by adjusting the offset length, it is possible to achieve matching at 50 ohms.

Furthermore, a planar antenna has been proposed (see, for example, Japanese Unexamined Patent Application Publication No. 11-103213) in which, for example, a patch antenna unit is arranged so as to face a ground conductor unit with a dielectric provided therebetween, the center conductor of a coaxial cable is inserted from the opening of the ground conductor plate in such a manner as to go through the dielectric in the thickness direction thereof, the center conductor is electrically connected at a point P of the patch antenna unit, and radio waves are transmitted or received with the point P functioning as a power-feed point. When a coaxial cable is to be connected to the patch antenna unit, the center conductor of the coaxial cable can be directly inserted into the dielectric, and can be connected to the power-feed point with soldering or the like. Therefore, it is possible to simplify the antenna configuration and also possible to decrease the manufacturing cost.

Furthermore, it is possible to adopt a configuration in which an opening is provided in the ground conductor plate, and power feeding is performed in an electromagnetically coupled manner through the opening from the back side of the ground conductor plate.

A planar antenna, such as a patch antenna, has problems that a surface wave (an electromagnetic wave propagated on the surface of a ground conductor plate) occurs on an antenna substrate, the surface wave is propagated to the end portion of the antenna substrate, and an unwanted electromagnetic wave (an unwanted electromagnetic wave resulting from a surface wave) is radiated from the end portion of the antenna substrate, causing a radiation pattern radiated from the antenna to be distorted. Another problem is that an unwanted electromagnetic wave resulting from a surface wave is radiated to a circuit substrate disposed in the surrounding area and another antenna substrate, whereby radio interference occurs, and malfunction of a semiconductor element occurs.

With regard to the above problems, a solving method of disposing a mechanism for suppressing the propagation of a surface wave on an antenna substrate has been known. As a mechanism for suppressing surface-wave propagation, there is a mechanism called a high impedance surface or artificial magnetic conductor (hereinafter will be simply abbreviated as an "AMC"). For example, by periodically arranging AMC elements having resonance characteristics on a ground conductor plate, it is possible to suppress the propagation of a surface wave.

FIG. 7 shows an example of the configuration (sectional view) of a planar antenna utilizing AMC elements (see, for example, U.S. Pat. No. 6,262,495, and Dan Sievenpiper, et al. "High-Impedance Electromagnetic Surfaces with a Forbidden Frequency Band" (IEEE Transactions on Microwave Theory And Techniques, Vol. 47, No. 11, pp. 2059-2074)). Individual AMC elements are of a thumbtack-type in which a plate-shaped conductor is supported by a post-shaped conductor. By arranging many thumbtack-type AMC elements in the area surrounding the patch antenna, propagation of a surface wave that reaches the end portion of the ground conductor and causes unwanted radiation (scattering in which an edge is a secondary-wave source point) is suppressed. By suppressing excessive unwanted radiation, the effect of increasing the gain in a desired direction (towards the front of the patch antenna, in the upward direction in the plane of FIG. 7) is expected.

Although it is difficult to see from FIG. 7 because FIG. 7 is a sectional view, thumbtack-type AMC elements in which a plate-shaped conductor is supported by means of a post-shaped conductor are periodically arranged in a two-dimensional manner in the area surrounding a patch antenna. Then, resonance is caused to occur by inductance components by the post-shaped conductor and capacitance components with the plate-shaped conductor. As a result, the propagation of the surface wave that occurs in the patch antenna disposed in the center to the peripheral edge is suppressed.

However, in practice, electromagnetic simulation performed by the inventors of the present invention revealed that a frequency exists at which, if thumbtack-type AMC elements having the above-described resonance characteristics are arranged in the area surrounding the radiation conductor plate, the gain is decreased. An AMC element is designed to suppress propagation of a surface wave that flows toward the end portion of the ground conductor. It is considered that a main reason for a decrease in the gain is that a new unwanted radiation source appears as a result of mounting AMC elements.

FIG. 8 shows, as an example of a result by electromagnetic simulation, frequency characteristics of a directional gain of a patch antenna in which AMC elements are arranged in the area surrounding the patch antenna, in comparison with a patch antenna of the related art in which AMC elements are not arranged in the area surrounding the patch antenna. In the simulation mentioned above, the impedance matching frequency of the patch antenna is generally set to 8 GHz and therefore, the main operating band thereof is also in the vicinity of 8 GHz. It can be seen from FIG. 8 that, although the gain has been improved over that of the patch antenna configuration of the related art at certain frequencies, the gain is lower than that of the patch antenna configuration of the related art in the vicinity of 8 GHz, which is the original operating band.

FIG. 9 shows a simulation result of a radiation pattern at 7.9 GHz in comparison with that of a patch antenna of the related art in which AMC elements are not arranged in the area surrounding the patch antenna. It can be seen from the figure that, in the case of a patch antenna having resonance characteristics, in which AMC elements are mounted in the area surrounding the patch antenna, the gain towards the front of the patch antenna is suppressed on, in particular, an H-plane ($\phi$=90 degrees plane).

SUMMARY OF THE INVENTION

It is desirable to provide a superior antenna apparatus having a patch antenna configuration configured by arranging a radiation conductor and a ground conductor plate in such a manner as to face each other with an insulating material disposed therebetween.

It is desirable to provide a superior antenna in which radiation of an unwanted electromagnetic wave resulting from a surface wave that occurs on an antenna substrate is suppressed, and distortion of a radiation pattern is thereby reduced.

It is desirable to provide a superior antenna in which propagation of a surface wave is suppressed by mounting AMC elements having resonance characteristics in the area surrounding a patch antenna unit, and thus an efficient improvement in gain is achieved.

The present invention has been achieved in consideration of the above-described problems. According to an embodiment of the present invention, there is provided an antenna apparatus including: a patch antenna unit in which a radiation conductor and a ground conductor plate are arranged so as to face each other with an insulating material disposed therebetween, a power-feed point is provided at a position slightly offset from the center of the radiation conductor, and a high-frequency electric field is supplied between the radiation conductor and the ground conductor plate; a surface-wave propagation suppression area in which a surface-wave propagation suppression mechanism for suppressing surface-wave propagation is mounted in an outer surrounding area in the offset direction of the power-feed point in which an electric-field intensity is generally maximum within the end portion of the radiation conductor plate; and an insulating area in which an electric-field intensity between the radiation conductor plate and the ground conductor plate is relatively low and the surface-wave propagation suppression mechanism is not arranged.

Examples of an antenna meeting the demand for a low-profile antenna include a patch antenna configured in such a manner that a radiation conductor and a ground conductor plate are arranged so as to face each other with an insulating material disposed therebetween. The patch antenna has advantages that manufacture is easy, and integration with a circuit substrate is easy. Furthermore, in the patch antenna, radiation directivity when it is excited in the lowest order mode generally indicates the single direction of a z-axis direction, and a directional gain of approximately several dBi is obtained.

A planar antenna, such as a patch antenna, has problems that a surface wave occurs on an antenna substrate, the surface wave is propagated to the end portion of the antenna substrate, and an unwanted electromagnetic wave is radiated from the end portion of the antenna substrate, causing a radiation pattern radiated from the antenna to be distorted. In regard to this, in order to suppress propagation of a surface wave on an antenna substrate, an antenna configuration for suppressing propagation of a surface wave by periodically arranging AMC elements having resonance characteristics in the area surrounding a patch antenna unit has been proposed.

However, the simulation performed by the inventors of the present invention revealed that a frequency exists at which, if a surface-wave propagation suppression mechanism, such as an AMC element having resonance characteristics, is arranged in the area surrounding the radiation conductor plate, the gain is decreased, and the gain towards the front of the patch antenna is suppressed.

Accordingly, in the antenna apparatus according to the embodiment of the present invention, by arranging a surface-wave propagation suppression mechanism in only an appropriate area in the area surrounding a patch antenna unit, it is possible to suppress the radiation of an unwanted electromagnetic wave by the propagation of a surface wave without causing a decrease in the gain in the original operating band or a decrease in the gain towards the front of the patch antenna, and an efficient improvement in gain is achieved.

Here, for the surface-wave propagation suppression mechanism, an AMC element having resonance characteristics, which is formed of a thumbtack-type configuration in which a plate-shaped conductor is supported by means of a post-shaped conductor, can be used.

The antenna apparatus has an electrical current distribution in the offset direction (that is, in the x-axis direction) of a power-feed point in the patch antenna unit, and the charging quantity, that is, the intensity of the electric field, becomes maximum at both edges in the x-axis direction. In the embodiment of the present invention, by mounting AMC elements in an area where such an intensity of the electric field becomes almost maximum (that is, at both edges in the offset direction), a TM mode wave (surface-wave propagation) that flows toward the end portion of the ground conductor is effectively suppressed. Then, by not arranging AMC elements in an area other than that where the intensity of the electric field becomes almost maximum (that is, an insulating area is provided), an unwanted radiation source that newly occurs as a result of the mounting of AMC elements is minimized.

According to the embodiment of the present invention, it is possible to provide a superior antenna apparatus having a patch antenna configuration configured by arranging a radiation conductor and a ground conductor plate in such a manner as to face each other with an insulating material disposed therebetween.

According to the embodiment of the present invention, it is possible provide a superior antenna in which radiation of an unwanted electromagnetic wave resulting from a surface wave that occurs on an antenna substrate is suppressed, and distortion of a radiation pattern is thereby reduced.

According to the embodiment of the present invention, it is possible provide a superior antenna in which propagation of a surface wave is suppressed by mounting AMC elements having resonance characteristics in the area surrounding a patch antenna unit, and an efficient improvement in gain is achieved.

Further other objects, features, and advantages of the present invention will become apparent from the more detailed description based on the embodiment of the present invention as will be described later and the attached drawings.

DESCRIPTION OF THE PREFERRED EMBODIMENT

An embodiment of the present invention will be described below with reference to the drawings.

Figure 1:
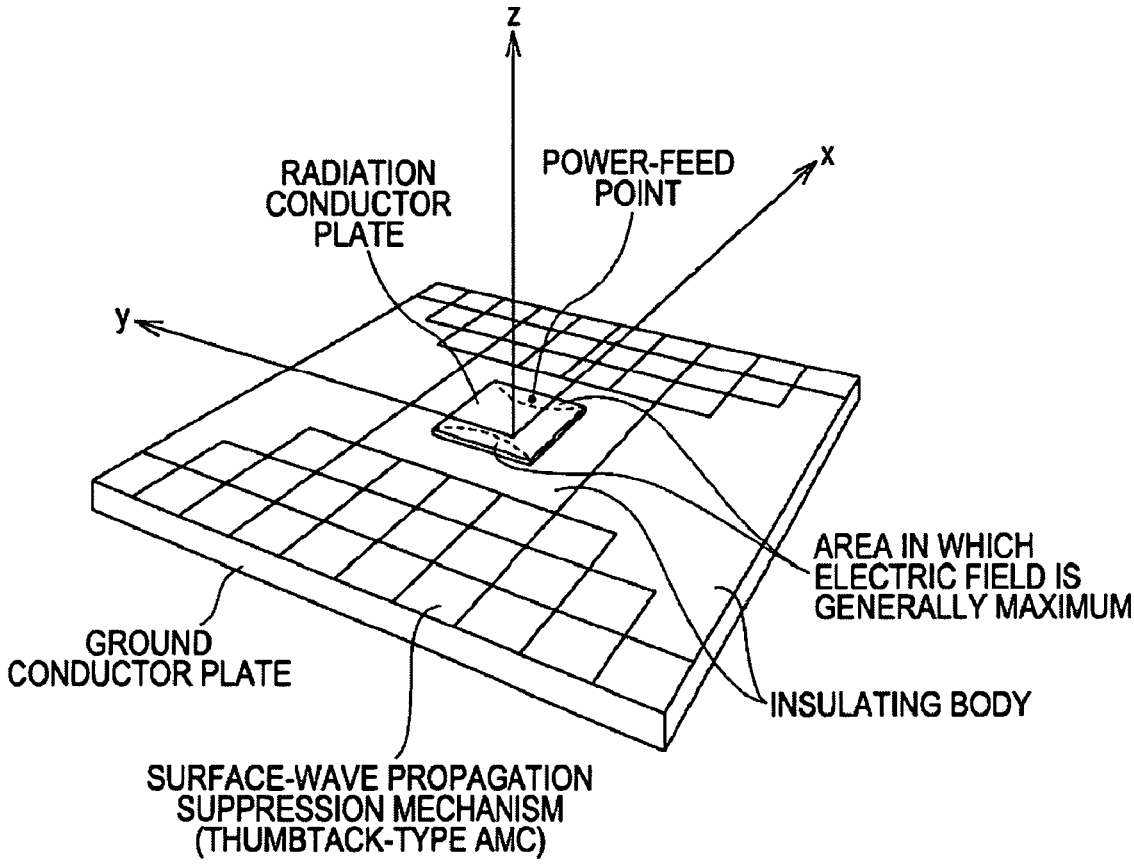
FIG. 1 shows the configuration of an antenna apparatus according to an embodiment of the present invention.

FIG. 1 shows the configuration of an antenna apparatus according to an embodiment of the present invention. The antenna apparatus shown in the figure is configured in such a manner that a surface-wave propagation suppression mechanism is disposed in the area surrounding a patch antenna unit in which a radiation conductor and a ground conductor plate are arranged so as to face each other with an insulating material disposed therebetween.

In the patch antenna unit, a power-feed point is provided at a position slightly offset from the center of the radiation conductor. As electrical current components in the offset direction of the power-feed point, that is, in the x-axis direction in the figure, increase, a radiation electric field is generated, and a standing wave is excited. Then, by adjusting the offset length, it is possible to achieve matching at 50 ohms. In the example shown in the figure, a patch antenna unit is configured by performing etching processing on a dielectric substrate, both sides of which are copper-clad.

Furthermore, the surface-wave propagation suppression mechanism is configured as an AMC element having resonance characteristics, which is formed of a thumbtack-type configuration in which a plate-shaped conductor is supported by a post-shaped conductor, as disclosed in U.S. Pat. No. 6,262,495 and Dan Sievenpiper, et al. "High-Impedance Electromagnetic Surfaces with a Forbidden Frequency Band" (IEEE Transactions on Microwave Theory And Techniques, Vol. 47, No. 11, pp. 2059-2074). Each AMC element is configured by performing etching processing on a dielectric substrate, both sides of which are copper-clad. In FIG. 1, the post-shaped conductor is concealed inside the insulating body and is not seen.

By mounting the surface-wave propagation suppression mechanism constituted by an AMC element in the area surrounding a patch antenna, it is possible to suppress a TM mode wave (surface-wave propagation) that flows toward the end portion of the ground conductor and to reduce radiation of an unwanted electromagnetic wave (an unwanted electromagnetic wave resulting from a surface wave) from the end portion of the antenna substrate. However, since an unwanted radiation source newly appears as a result of mounting an AMC element, a frequency at which the gain is decreased exists.

The antenna apparatus has an electrical current distribution in the offset direction (that is, in the x-axis direction) of the power-feed point in the patch antenna unit, and the charging quantity, that is, the electric-field intensity, becomes maximum at both edges in the x-axis direction. As described above, in order to effectively suppress the surface-wave propagation, the area surrounding the end portion (the outer surrounding area in the x-axis direction), in which the electric-field intensity generally becomes maximum, within the end portion of the radiation conductor plate, is an area in which an AMC element should be mounted.

On the other hand, in an area in which the electric-field intensity between the radiation conductor plate and the ground conductor plate is relatively low, even if an AMC element is mounted, the significant effect of suppressing surface-wave propagation is difficult to be expected, whereas it is considered that a new unwanted radiation source is formed. Accordingly, as shown in FIG. 1, by forming an insulating area in which AMC elements are not mounted (the conductor is removed by etching) in other than the outer surrounding area in the x-axis direction, the appearance of a new unwanted radiation source is suppressed.

Figure 2:
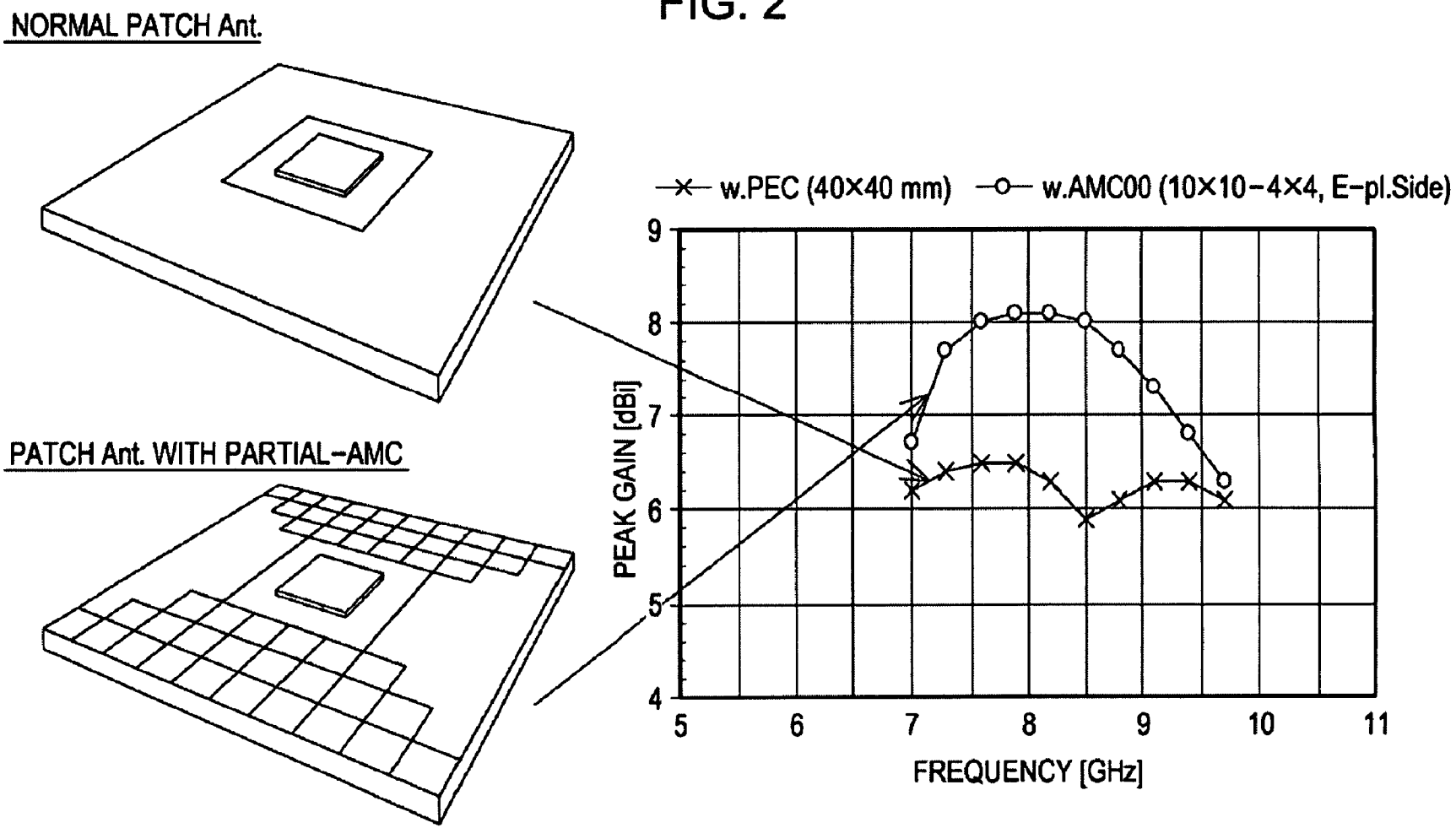
FIG. 2 shows frequency characteristics of the directional gain of the antenna apparatus shown in FIG. 1 in comparison with those of a patch antenna of the related art, in which AMC elements are not arranged in the surrounding area.

FIG. 2 shows frequency characteristics of a directional gain of the antenna apparatus shown in FIG. 1, in comparison with those of a patch antenna of the related art, in which AMC elements are not arranged in the area surrounding the patch antenna. However, in the simulation mentioned above, the impedance matching frequency of the patch antenna is generally set at 8 GHz and therefore, the main operating band thereof is also in the vicinity of 8 GHz. It can be seen from FIG. 2 that, for the antenna apparatus in which AMC elements shown in FIG. 1 are partially arranged in the area surrounding the patch antenna unit, a result that the gain is greater by approximately 1 to 2 dB than that of the patch antenna configuration of the related art is obtained.

Figure 3:
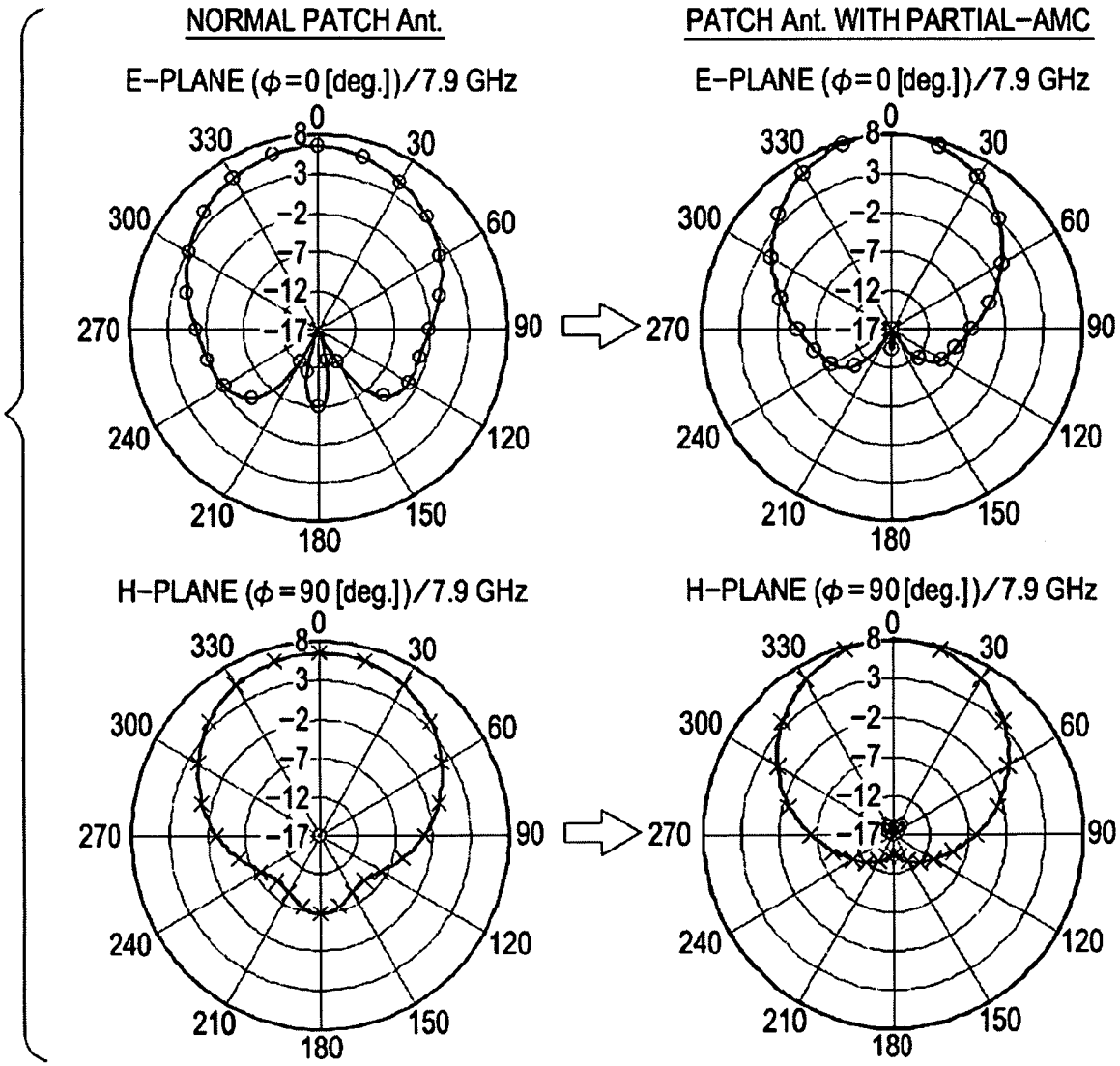
FIG. 3 shows the simulation result of a radiation pattern at 7.9 GHz in the antenna apparatus shown in FIG. 1, in comparison with that of a patch antenna of the related art in which AMC elements are not arranged in the surrounding area.

FIG. 3 shows the simulation result of a radiation pattern at 7.9 GHz for the antenna apparatus shown in FIG. 1, in comparison with that of a patch antenna of the related art in which AMC elements are not arranged in the area surrounding the patch antenna. It can be seen from FIG. 3 that, according to the antenna apparatus in which AMC elements shown in FIG. 1 are partially arranged in the area surrounding the patch antenna unit, the shape of the radiation pattern is not disturbed, the radiation towards the back of the antenna resulting from edge scattering is suppressed, and as a result, the gain towards the front of the antenna is improved.

As described above, the antenna apparatus according to the embodiment of the present invention has features that the appearance of a new unwanted radiation source is suppressed by mounting AMC elements for suppressing surface-wave propagation in the outer surrounding area in the x-axis direction in which the electric-field intensity generally becomes maximum within the end portion of the radiation conductor plate and by not arranging AMC elements in an area in which the electric-field intensity between the radiation conductor plate and the ground conductor plate becomes relatively low in order to form an insulating area. However, the method of arranging AMC elements in the area surrounding the patch antenna is not limited to that of FIG. 1.

Figure 4:
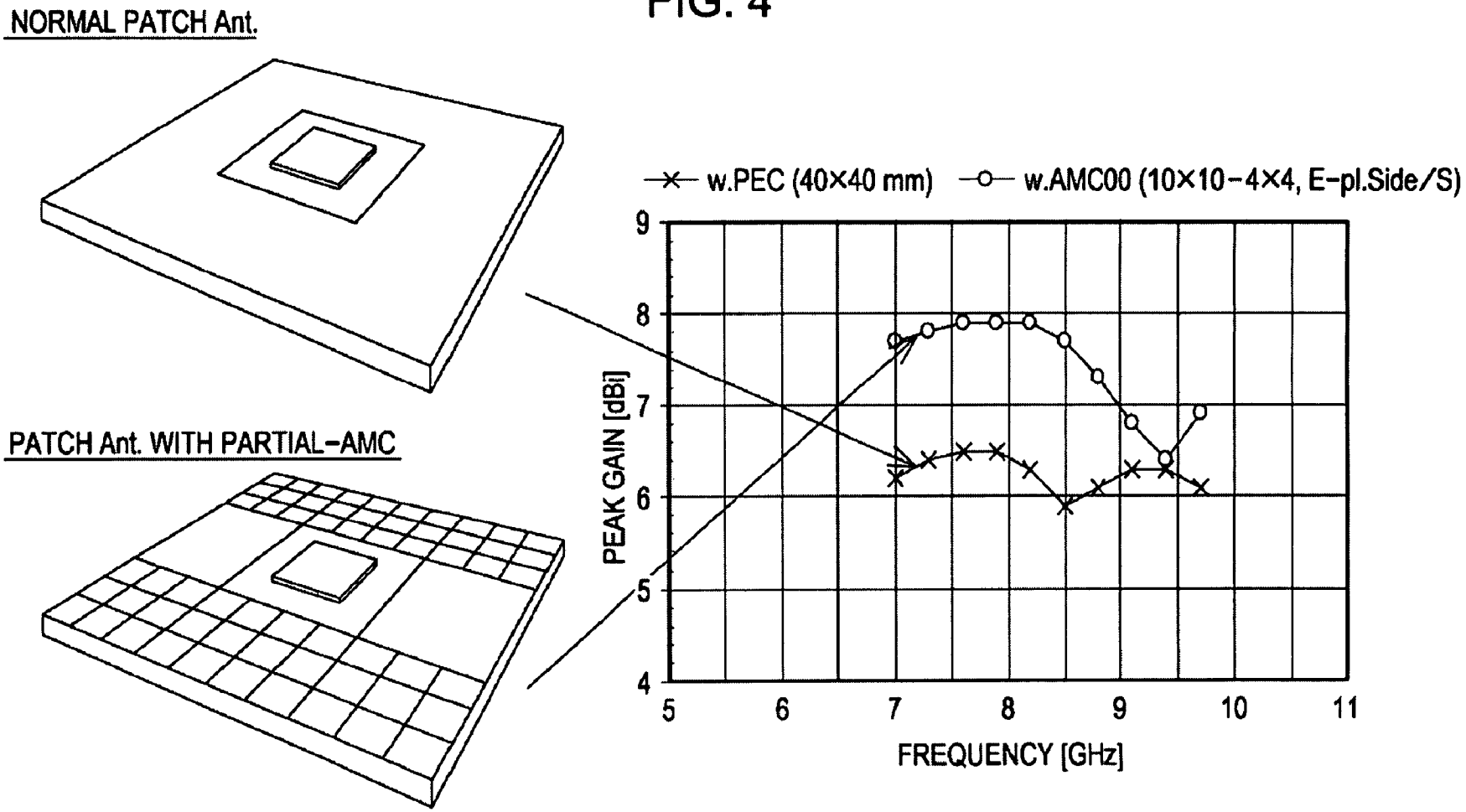
FIG. 4 shows another example of the configuration of an antenna apparatus in which AMC elements are arranged in only the outer surrounding area in an x-axis direction in which the electric-field intensity generally is maximum within the end portion of a radiation conductor plate, and frequency characteristics of the directional gain thereof, in comparison with frequency characteristics of a patch antenna of the related art, in which AMC elements are not arranged in the area surrounding the antenna, which has the same topology as described above.
Figure 5:
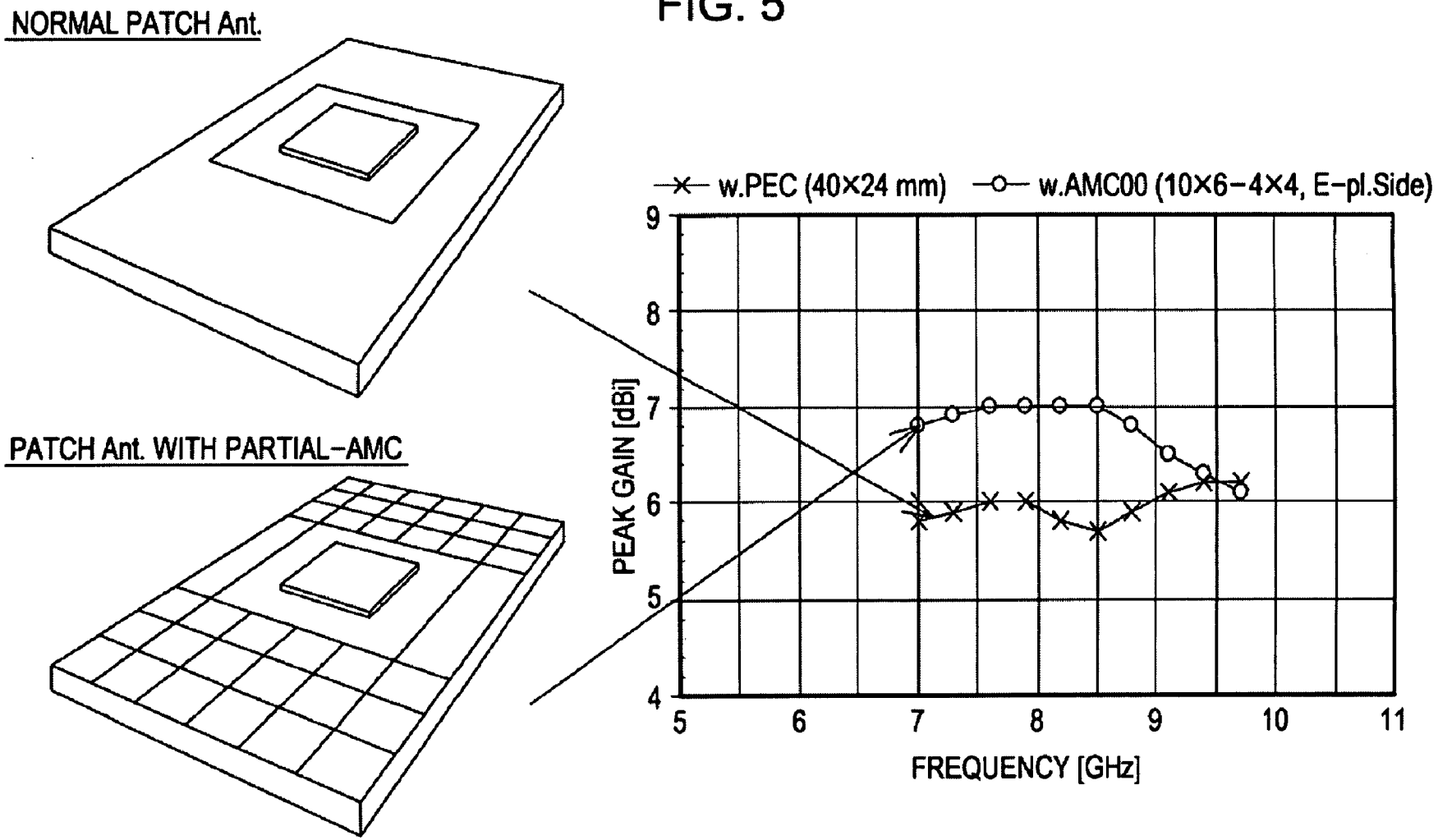
FIG. 5 shows another example of the configuration of an antenna apparatus in which AMC elements are arranged in only the outer surrounding area in an x-axis direction in which the electric-field intensity generally is maximum within the end portion of a radiation conductor plate, and frequency characteristics of the directional gain thereof, in comparison with frequency characteristics of a patch antenna of the related art, in which AMC elements are not arranged in the area surrounding the antenna, which has the same topology as described above.
Figure 6:
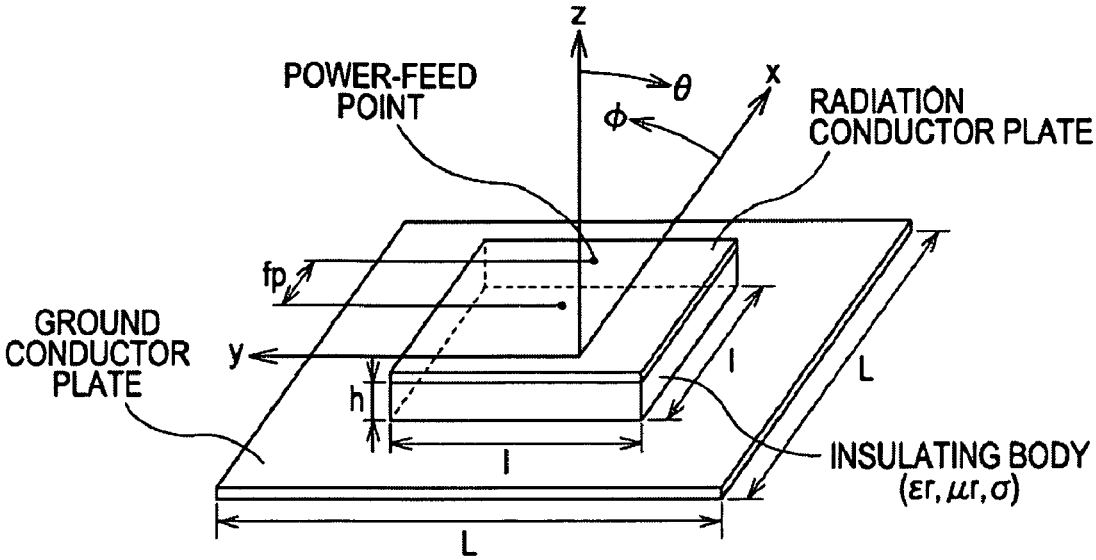
FIG. 6 shows an example of the configuration of a patch antenna.
Figure 7:
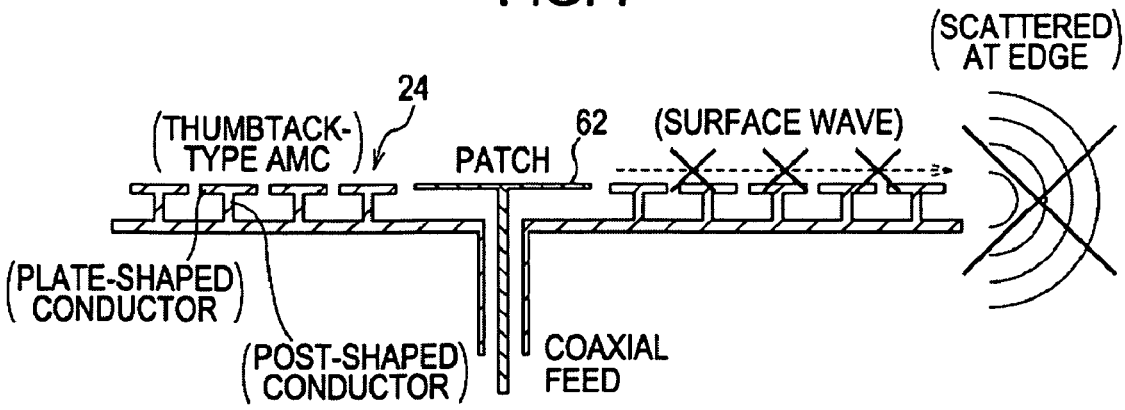
FIG. 7 shows an example of the configuration (sectional view) of a planar antenna utilizing AMC elements.
Figure 8:
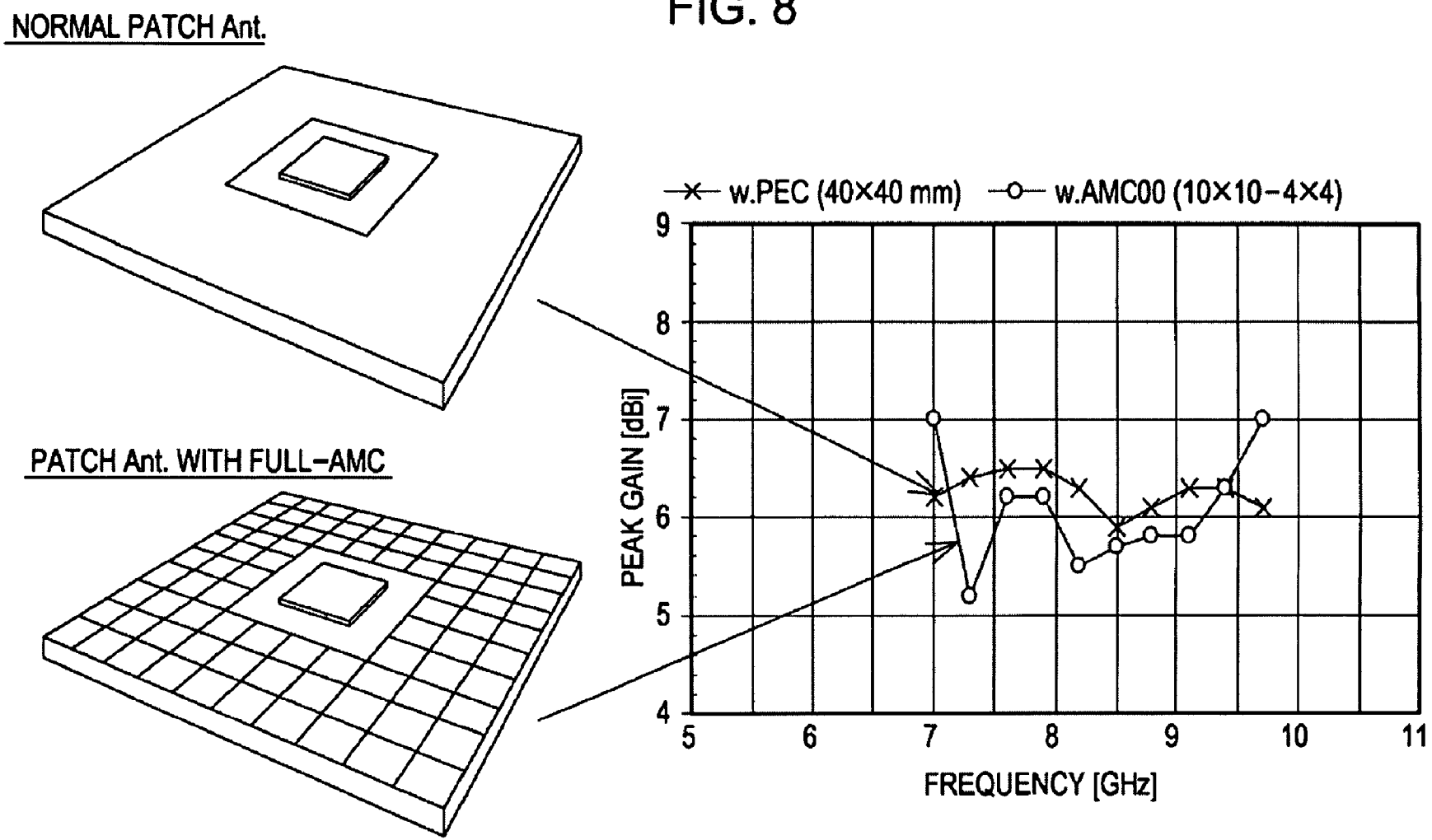
FIG. 8 shows frequency characteristics of a directional gain of a patch antenna in which AMC elements are arranged in the surrounding area in comparison with those of a patch antenna of the related art in which AMC elements are not arranged in the surrounding area.
Figure 9:
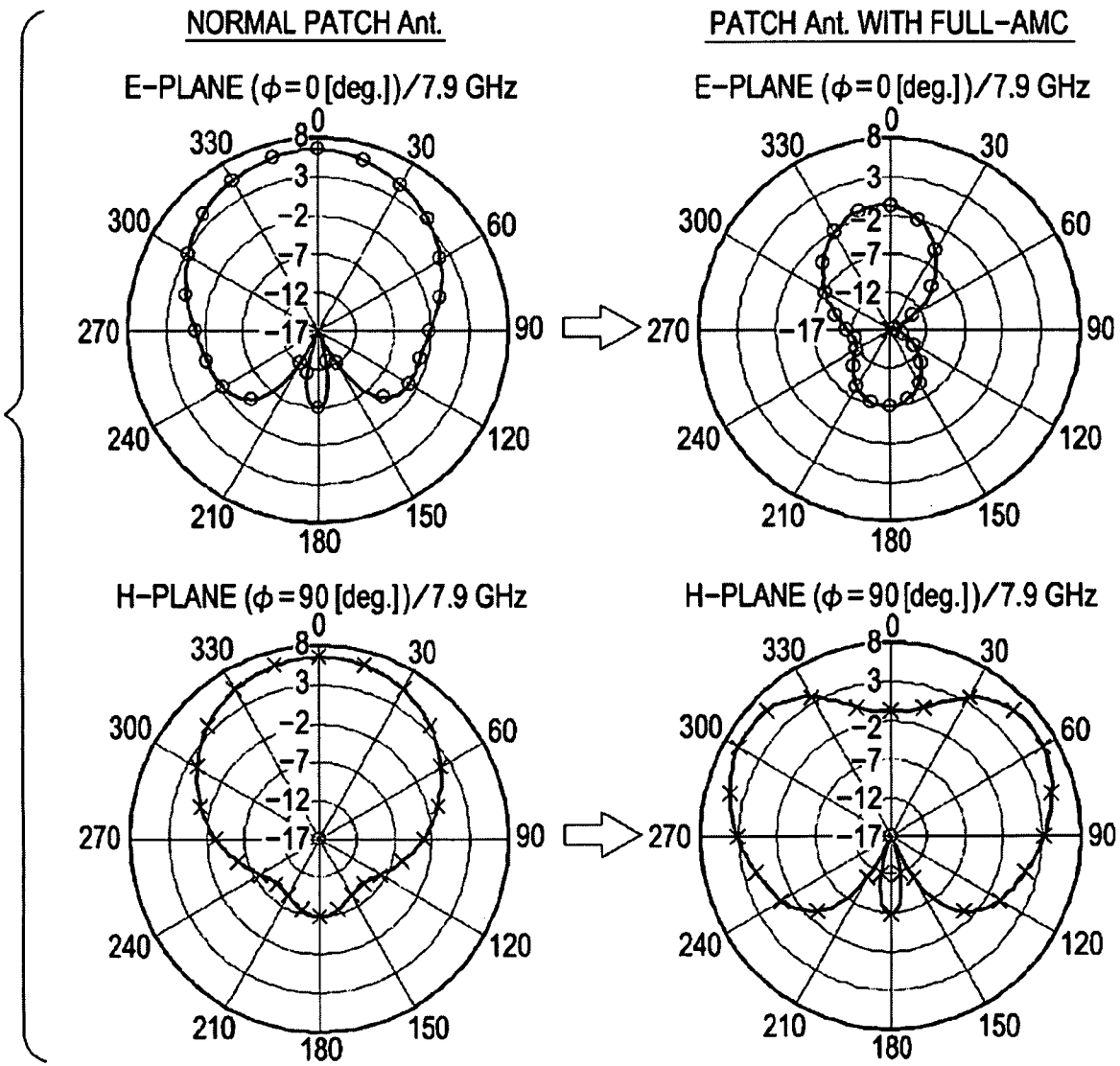
FIG. 9 shows a simulation result of a radiation pattern at 7.9 GHz in comparison with that of a patch antenna of the related art in which AMC elements are not arranged in the surrounding area.

FIGS. 4 and 5 show another example of the configuration of an antenna apparatus in which AMC elements are arranged in only the outer surrounding area in the x-axis direction in which the electric-field intensity generally becomes maximum within the end portion of the radiation conductor plate, and frequency characteristics of the directional gain thereof, in comparison with frequency characteristics of a patch antenna of the related art in which AMC elements are not arranged in the surrounding area, which is the same topology as described above. However, in the simulation mentioned above, the impedance matching frequency of the patch antenna is generally set to 8 GHz and therefore, the main operating band thereof is also in the vicinity of 8 GHz. It can be seen from FIGS. 4 and 5 that, for the antenna apparatus in which AMC elements are partially arranged in the area surrounding the patch antenna unit, a result that the gain is greater than that of the patch antenna configuration of the related art is obtained.

The gist of the present invention lies in that AMC elements are partially arranged in only the area surrounding an end portion in which the electric-field intensity generally becomes maximum. However, the present invention is not intended to be limited to a specific arrangement method shown in FIGS. 1, 4, and 5.

Furthermore, in this specification, a description has been given of a surface-wave propagation suppression mechanism by mainly using, as an example, a thumbtack-type AMC element in which a plate-shaped conductor is supported by a post-shaped conductor. However, the gist of the present invention is not limited to this example. For example, it is possible to apply an AMC element of a type in which texture is applied to a plate-shaped conductor without using a post-shaped conductor (see, for example, Douglas J. Kern, et al. "The Design Synthesis of Multiband Artificial Magnetic Conductors Using High Impedance Frequency Selective Surfaces" (IEEE Transactions on Antennas and Propagation, Vol. 53, No. 1, pp. 8-17)).

It should be understood by those skilled in the art that various modifications, combinations, sub-combinations and alterations may occur depending on design requirements and other factors insofar as they are within the scope of the appended claims or the equivalents thereof.

What is claimed is:

1. An antenna apparatus comprising:

a patch antenna unit in which a radiation conductor and a ground conductor plate are arranged so as to face each other with an insulating material disposed therebetween, a power-feed point is provided at a position slightly offset from the center of the radiation conductor, and a high-frequency electric field is supplied between the radiation conductor and the ground conductor plate;

a first surface-wave propagation suppression area in which a surface-wave propagation suppression mechanism for suppressing surface-wave propagation is mounted in a first outer surrounding area of the ground conductor plate in the offset direction of the power-feed point;

a second surface-wave propagation suppression area in which a second wave propagation suppression mechanism for suppressing surface-wave propagation is mounted in a second outer surrounding area of the ground conductor plate in a direction opposite the offset direction of the power-feed point; and an insulating area in which an electric-field intensity between the radiation conductor plate and the ground conductor plate is relatively low and the surface-wave propagation suppression mechanism is not arranged.

2. The antenna apparatus according to claim 1, wherein, in each of the surface-wave propagation suppression areas, a plurality of thumbtack-type artificial magnetic conductor elements, in each of which a plate-shaped conductor is supported by a post-shaped conductor, are arranged.

3. The antenna apparatus according to claim 1, wherein, in each of the surface-wave propagation suppression areas, an artificial magnetic conductor element, in which texture is applied to a plate-shaped conductor, is arranged.

* * * * *